US006253725B1

(12) United States Patent
Groddeck et al.

(10) Patent No.: US 6,253,725 B1
(45) Date of Patent: Jul. 3, 2001

(54) CRANKCASE AND METHOD OF MAKING SAME

(75) Inventors: Michael Groddeck; Michael Hartmann, both of Meckenbeuren; Franz Edmaier, Friedrichshafen, all of (DE)

(73) Assignee: MTU Mortoren- und Turbinen-Union Friedrichshafen GmbH, Friedrichshafen (DE)

( * ) Notice: Subject to any disclaimer, the term of this patent is extended or adjusted under 35 U.S.C. 154(b) by 0 days.

(21) Appl. No.: 09/452,946

(22) Filed: Dec. 2, 1999

(30) Foreign Application Priority Data

Dec. 2, 1998 (DE) ..... 198 55 562

(51) Int. Cl.[7] ..... F02F 7/00
(52) U.S. Cl. ..... 123/195 R
(58) Field of Search ..... 123/195 R, 195 H

(56) References Cited

U.S. PATENT DOCUMENTS 4,369,744 * 1/1983 Kubozuka et al. ..... 123/198 E
4,690,112 * 9/1987 Arnold ..... 123/195 R
5,115,791 * 5/1992 Dore ..... 123/193.2
5,131,357 * 7/1992 Inoue et al. ..... 123/195 H
5,662,080 * 9/1997 Isono et al. ..... 123/195 C

OTHER PUBLICATIONS

"MTU Friedrichshafen, Products and Services, Series 880, Edition 1/98."

* cited by examiner

*Primary Examiner*—Willis R. Wolfe
*Assistant Examiner*—Hyder Ali
(74) *Attorney, Agent, or Firm*—Crowell & Moring, L.L.P.

(57) ABSTRACT

For an internal-combustion engine in a V-arrangement, a crankcase has a parallelepiped-shaped construction with a rectangular cross-section. The base side of the crankcase corresponds approximately to the lateral projection in the area of the cylinder heads. In addition, the crankcase has at least one chamber. Preferably, several chambers are provided corresponding to the number of cylinders of the internal-combustion engine. These chambers point from the longitudinal side of the crankcase into the interior. Auxiliary assemblies, heat exchangers, filters and oil supply spaces are arranged in these chambers.

43 Claims, 6 Drawing Sheets

CRANKCASE AND METHOD OF MAKING SAME

BACKGROUND AND SUMMARY OF THE INVENTION

This application claims the priority of German application 198 55 562.8, filed Dec. 2, 1998 in Germany, the disclosure of which is expressly incorporated by reference herein.

The invention relates to a crankcase for an internal-combustion engine in a V-arrangement.

A crankcase of this type is known from the publication "MTU Friedrichshafen, Products and Services, Series 880, Edition January 1998". The cross-section of this crankcase has a y-shaped structure. In the area of the crankshaft space, the auxiliary assemblies heat exchanger, filter and oil supply spaces as well as their connection lines are arranged on the outside of the crankcase.

Based on the above-described state of the art, it is an object of the invention to further develop this state of the art.

According to the invention, this object is achieved in that the crankcase is constructed in a parallelepiped shape with a rectangular cross-section. In this case, the base side of the parallelepiped corresponds approximately to the lateral projection in the area of the cylinder heads. In addition, the crankcase has at least one chamber which extends from the longitudinal side of the crankcase into the interior. This chamber is formed of the two crankcase end walls, a portion of the base area and a wall bounding the crankshaft space. According to certain preferred embodiments of the invention, a chamber is preferably arranged on each longitudinal side of the crankcase.

According to certain preferred embodiments of the invention, it is suggested that several chambers be arranged on a longitudinal side, in which case the chambers are separated from one another by one transverse wall respectively, and this transverse wall is constructed in one piece with the crankcase.

According to the invention, the crankcase is constructed as a simple box structure. As it is known, such a box structure has a high rigidity with respect to torsion and bending. The forces resulting from the combustion can therefore be diverted in a targeted manner. It is an important advantage in comparison to the internal-combustion engine known from the state of the art that an internal-combustion engine having the crankcase according to the invention, despite supplying the same power, has a significantly smaller overall size. In other words, an internal-combustion engine having the crankcase according to the invention, has, relative to the same output, cross-sectional dimensions which are so small that a crankcase according to the state of the art with a comparable cross-sectional dimension would have a very poor resistance to bending and torsion. As it is known, the section modulus increases with the 4th power of the height or width of the box dimensions.

As a further development of preferred embodiments of the invention, it is suggested that the auxiliary assemblies heat exchanger, filter spaces and oil supply spaces be arranged in the chambers. As a further development, it is suggested that the auxiliary assemblies, particularly the oil pumps and the oil supply spaces, be arranged in the chambers on one side of the crankcase. In contrast, the heat exchangers and filters are arranged on the other side. This results in the advantage of a clear structuring and therefore in a reduction of the connection lines.

As a further development of preferred embodiments of the invention, it is suggested that one chamber in itself represents a closed oil supply space. As an alternative, several chambers of one side may be connected with one another so that they form a common oil supply space. As a further development, it is suggested that the chambers be closed off with respect to the atmosphere by means of a covering. Thus, the whole oil guiding system is fully integrated in the crankcase—without any separate housing or container. The transition of the chamber used as the oil supply space to the crankshaft space is constructed as a single wall. In contrast, the crankcase from the state of the art and, for example, an oil supply reservoir, represent two separate components. The crankcase/oil supply reservoir connection is therefore constructed as a double wall, in which case the line leadthroughs must be machined and sealed off correspondingly.

As additional constructive measures for increasing the rigidity of the crankcase, it is provided according to certain preferred embodiments of the invention that, in the area of the crankshaft space, the crankcase is closed off by means of a jointly carrying bottom cover. In addition, a crossbar is provided according to certain preferred embodiments of the invention in the area of the base surface in the case of each front or end wall.

Other objects, advantages and novel features of the present invention will become apparent from the following detailed description of the invention when considered in conjunction with the accompanying drawings.

DETAILED DESCRIPTION OF THE DRAWINGS

Figure 1:
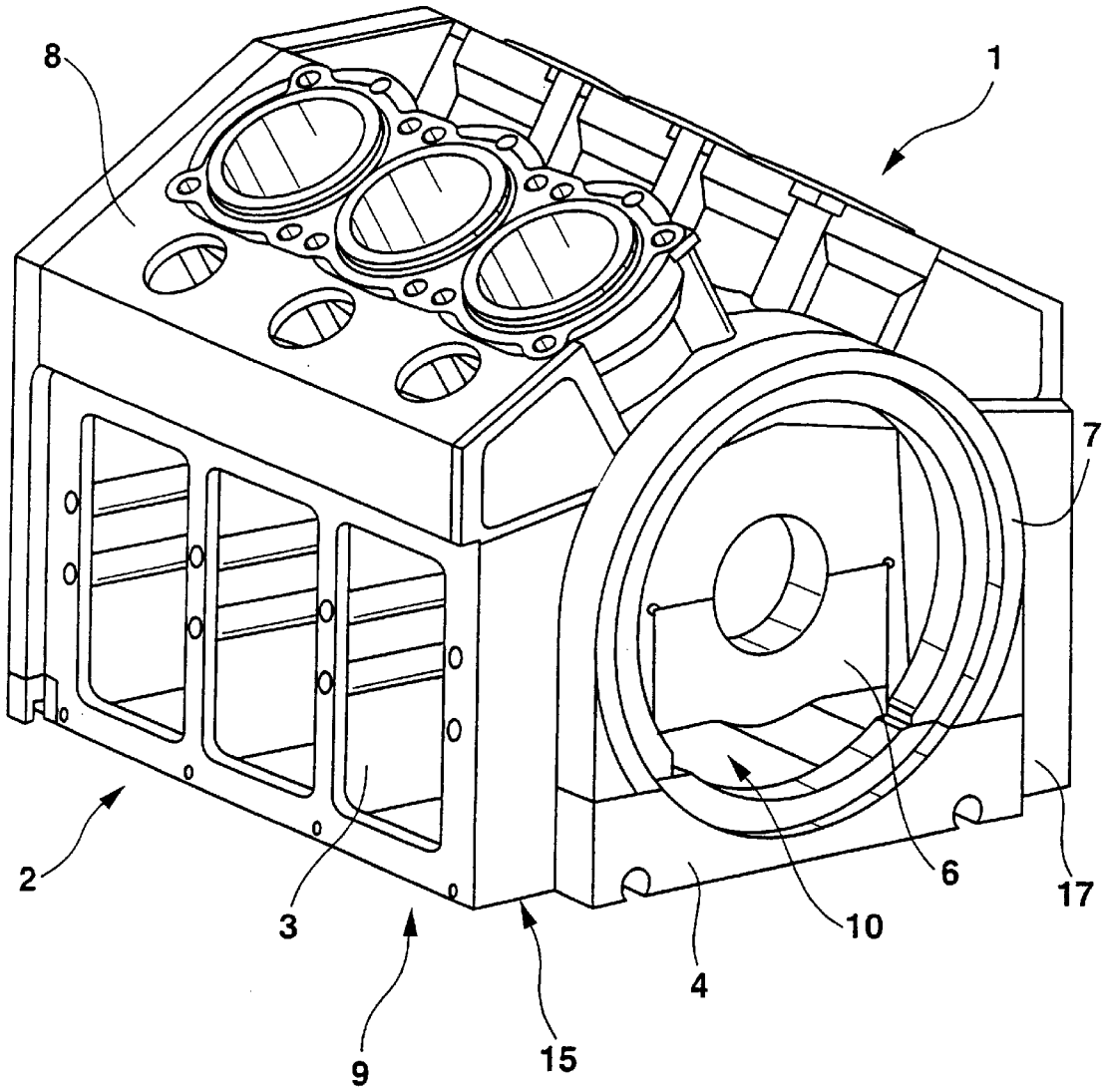
FIG. 1 is a perspective view from the power side of a crankcase constructed according to a preferred embodiment of the invention.
Figure 2:
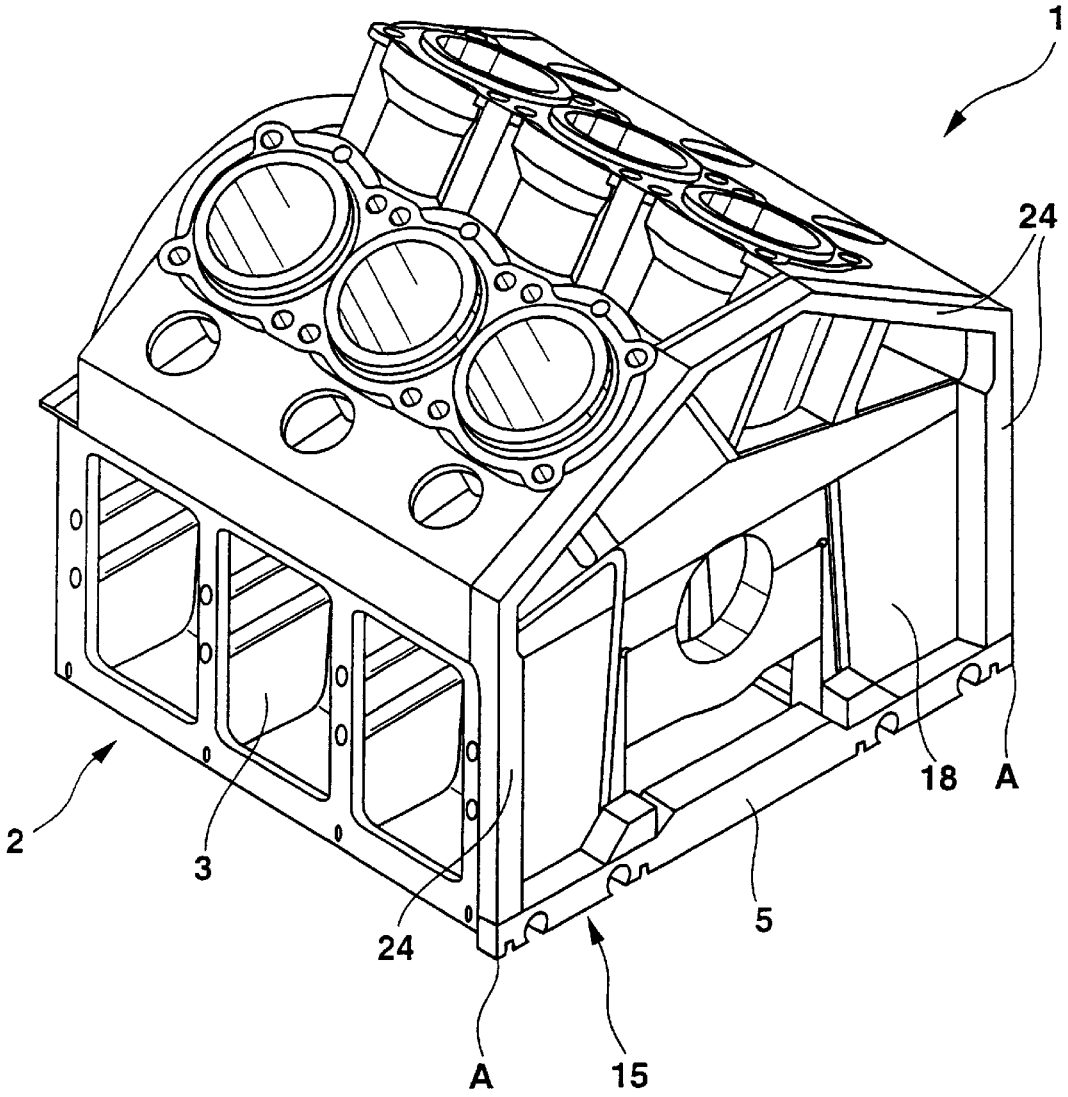
FIG. 2 is a perspective view of the side opposite the power side of the crankcase of FIG. 1.

FIG. 1 illustrates a crankcase 1 with a view of the power side. The crankcase 1 is typically made of cast aluminum. It is constructed in a parallelepiped shape with a rectangular cross-section, the base side of the parallelepiped corresponding approximately to the lateral projection in the area of the cylinder heads (maximal engine width). In FIG. 2, the base side 15 corresponds to the course AA. The cylinder heads, which are not shown in FIG. 1, rest against the supporting surface 8 (compare cylinder heads 16 schematically depicted in FIG. 4). The crankcase 1 has at least one chamber 2. The crankcase 1 illustrated in FIG. 1 has three chambers 2. Preferably, one chamber 2 per side is provided for each two-cylinder set. For an internal-combustion engine having six cylinders, there are therefore three chambers 2 per side. The chamber 2 situated on the power side is formed of a first front or end wall 17, the transverse wall 3, a portion of the base surface 9 and a wall 19 (FIG. 4) bounding the crankshaft space 10. This wall 19 is not shown in FIG. 1 because it is situated inside the crankcase 1. The auxiliary assemblies heat exchanger, filter and oil supply spaces are arranged in the chambers 2. Preferably, the auxiliary assemblies, particularly the oil pumps and the oil supply spaces are arranged in the chambers 2 on one side of the crankcase 1. In contrast, the heat exchangers and the filters are arranged in the chambers 2 on the other side of the crankcase 1. In addition to a clear structure, this results in the advantage of short connection lines. The chambers 2 are closed off with respect to the atmosphere by means of a covering 20. In the mounted condition, the covering 20 extends along the whole lateral surface of the crankcase 1. This is illustrated in FIG. 4.

A chamber 2 may represent an oil supply space which is closed in itself. As an alternative, several chambers 2 of one side may also be connected with one another and together form an oil supply space. As a result, it is possible to fully integrate the complete oil system of the internal-combustion engine—without a separate housing or container—into the crankcase.

In the area of the base surface 9, the first end wall 17 has a first cross bar 4. The cross bar 4 is used for reinforcing the crankcase 1. The advantage of the "built-up housing" according to the invention having the cross bars is the avoidance of so-called three-country corners at the lower and front-side seals. They allow sealing surfaces in a plane with O-ring grooves in the covers. Reference number 7 indicates a flange ring on the power side of the crankcase 1 which forms a flange-mounting surface together with the cross bar 4.

FIG. 2 shows the crankcase 1 with a view of the side opposite the power side. Reference number 18 shows a second end wall. In the area of the base surface 9, the second front wall 18 has a second cross bar 5. The function corresponds to that of the first cross bar 4 of FIG. 1. Together with the surrounding front surface 24 of the crankcase, the cross bar 5 forms the flange-mounting surface for a transmission case cover housing. The arrangement and the function of the chambers 2 correspond to these of FIG. 1. In addition, FIG. 2 shows a bearing bridge 6. Inside the crankcase 1, several bearing bridges are arranged and, as known, are used as bearing supports for the crankshaft. For absorbing the forces exercised by the crankshaft, the bearing bridge 6 has two screwed connections as shown. Reference is made in this regard to FIG. 4. The base side 15 of the crankcase 1 corresponds approximately to the lateral projection in the area of the cylinder heads. The base side 15 corresponds to the course AA.

Figure 3:
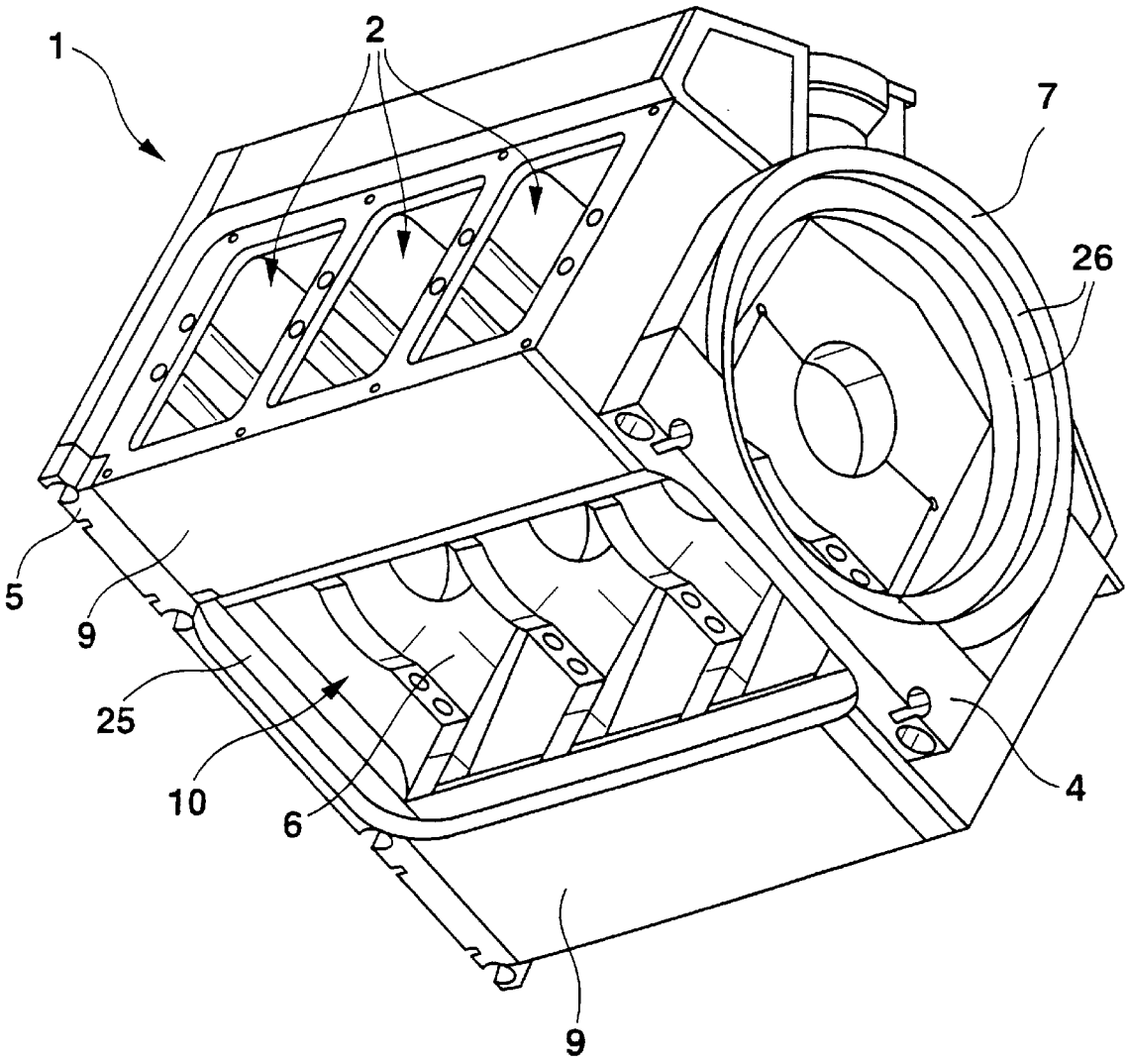
FIG. 3 is a perspective view of the base surface of the crankcase of FIG. 1.

FIG. 3 shows the crankcase 1 with a view of the base surface 9. The function and the arrangement of the bearing bridges 6, of the chambers 2 and of the two cross bars 4 and 5 correspond to those in FIGS. 1 and 2. After the milling of the bearing channel and of the cross bar contact surface, the two cross bars 4 and 5 are wetted with a sealing medium and are undetachably screwed and pinned to the crankcase 1. Subsequently, a flange mounting surface 25 for a bottom lid 12, the two cross bars 4 and 5 as well as the flange ring 7 with the centering and sealing surfaces 26 will be finished. The crankshaft space 10 is closed off with respect to the atmosphere by means of the bottom lid 12. This bottom lid 12 contributes to the supporting structure and is illustrated in FIG. 4.

Figure 4A:
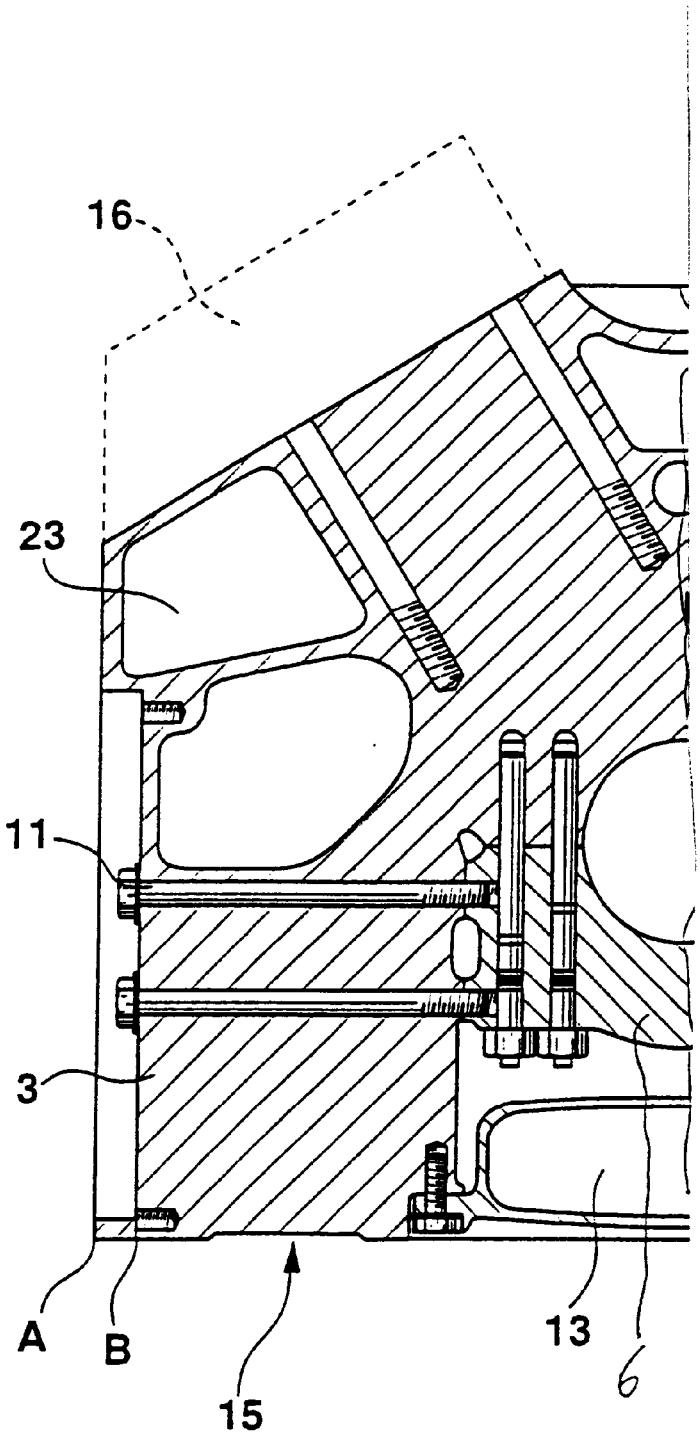
FIG. 4A is a cross-sectional view of the crankcase of FIG. 1, taken through a transverse wall.
Figure 4B:
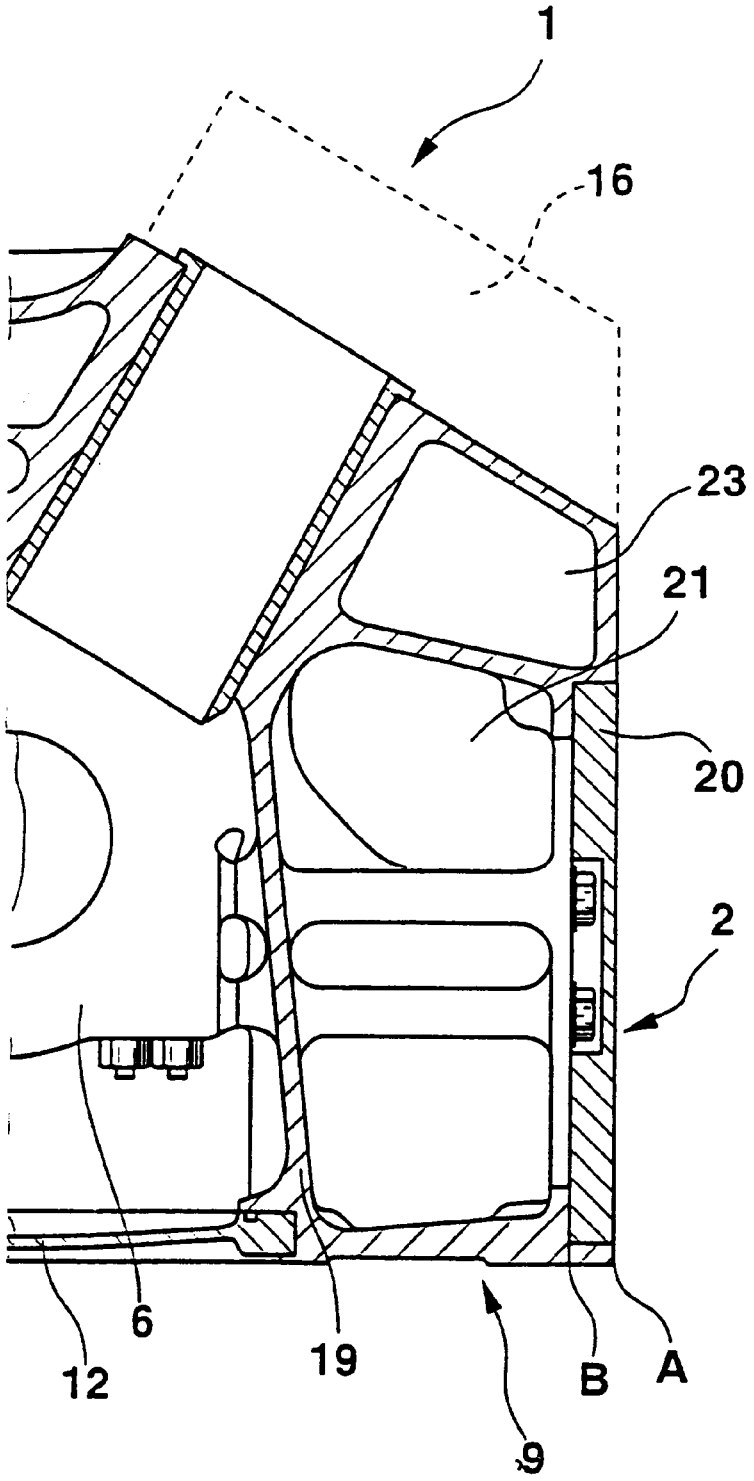
FIG. 4B is a cross-sectional view of the crankcase of FIG. 1, taken through a chamber.

FIGS. 4A and 4B are cross-sectional views of the crankcase 1. In this case, the left half (FIG. 4A) is implemented as a cross-section through a transverse wall 3. The right half (FIG. 4B) is implemented as a cross-section through a chamber 2.

Concerning the cross-section through a chamber (right half of FIG. 4B):

Reference number 2 shows a chamber. This chamber 2 is formed by a portion of the base surface 9, a wall 19 bounding the crankshaft space 10 as well as a covering 20 which seals off the chamber 2 with respect to the atmosphere. In this case, the chamber 2 may represent an oil supply space which is closed in itself. As an alternative, several chambers 2 of one side may also be connected with one another and form a common oil supply space. Reference number 21 shows such an opening to another chamber 2. The oil pumps are situated inside the oil supply space—chambers 2. The covering 20 is jointly supporting and a portion of the rigidity concept. Reference number 23 shows a charge air collecting tube which is at least partially an integral component of the crankcase 1.

Concerning the cross-section through a transverse wall (left half of FIG. 4A):

Reference number 3 illustrates the transverse wall. This transverse wall is constructed in one piece with the crankcase 1. The transverse wall 3 is used for increasing the rigidity of the crankcase 1 as well as for forming the chambers 2. The covering 20 was omitted in this representation of FIG. 4A. Reference number 6 illustrates a bearing bridge. This bearing bridge is fastened to the crankcase 1 from the direction of the base surface 9 as well as from the direction of the lateral surface by means of screws 11. This transverse screwed connection, thus from the direction of the lateral surface, extends out to the exterior edge B of the transverse wall 3. An advantage is a large unscrewing torque as the result of the large screw length. Another advantage is the pressure prestressing of the case and an improved diversion of the forces onto the whole box structure. In the area of the crankshaft space 10, the crankcase 1 is closed off by means of a bottom lid 12. The bottom lid 12 contributes to the rigidity of the crankcase 1. An additional oil supply space 13 is arranged on this bottom lid 12. As illustrated in FIG. 4, the crankcase 1 is constructed in a parallelepiped shape with a rectangular cross-section. The base side 15 of the crankcase 1 corresponds approximately to the lateral projection (maximal engine width) in the area of the cylinder heads 16, thus of the course AA.

Figure 5:
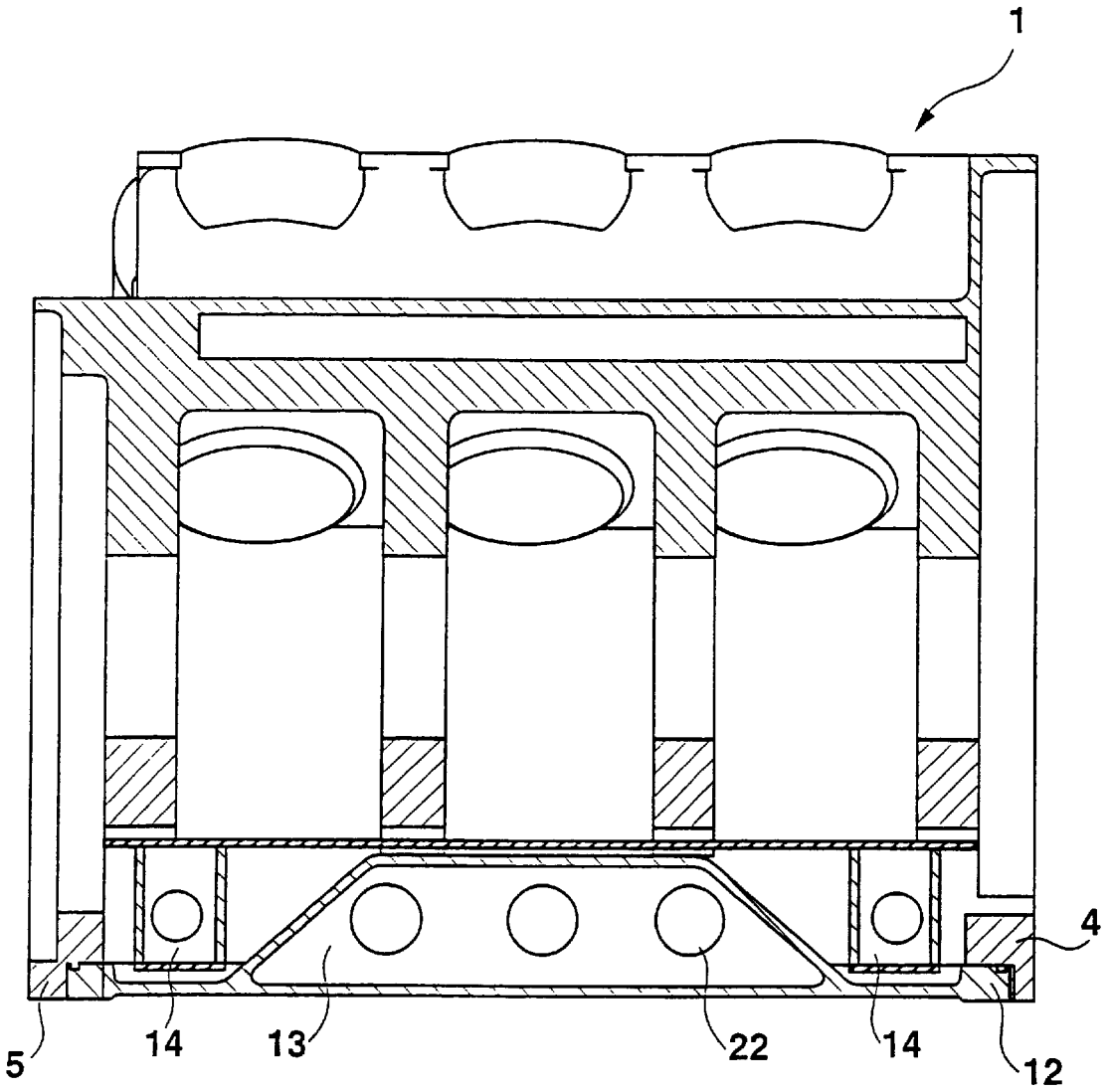
FIG. 5 is a longitudinal sectional view of the crankcase of FIG. 1.

FIG. 5 is a cross-sectional view of the crankcase 1 in the longitudinal direction. The reference number 4 shows the first cross bar and the reference number 5 shows the second cross bar. Reference number 12 shows the bottom lid with the integrated oil supply space 13. From this oil supply space 13, lines 22 lead into the crankcase 1. Reference number 14 indicates two suction points for the oil pumps. By way of these suction points, the oil pumps suck the oil from the lower area of the crankcase 1 into the oil supply spaces—chambers 2—, and to the consuming devices, such as the pressure pump. The bottom lid 12 closes off the crankshaft space 10 with respect to the atmosphere.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Crankcase for an internal-combustion engine in a V-arrangement, wherein the crankcase has a parallelepiped construction with a rectangular cross-section, a base side of the parallelepiped corresponding approximately to a lateral projection in an area of cylinder heads installed in use on the crankcase, wherein in an in use position the crankcase has at least one chamber which extends from a longitudinal side of the crankcase into the interior of the crankcase, and wherein the at least one chamber is formed of crankcase end walls, a portion of a base surface and a wall bounding a crankshaft supporting space.

2. Crankcase according to claim 1, wherein one of said chambers is arranged on each longitudinal side of the crankcase.

3. Crankcase according to claim 1, wherein a plurality of said chambers are arranged on each longitudinal side of the crankcase, the chambers being separated from one another by means of one transverse wall respectively, and wherein the transverse walls are constructed in one piece with the crankcase.

4. Crankcase according to claim 3, wherein auxiliary assemblies, heat exchangers, filters and oil supply spaces are arranged in the chambers.

5. Crankcase according to claim 4, wherein the auxiliary assemblies, in the form of pumps, and the oil supply spaces are arranged in respective chambers on one side of the crankcase and the heat exchangers and filters are arranged in respective chambers on the other side of the crankcase.

6. Crankcase according to claim 3, wherein one of the chambers forms a closed oil supply space for an engine formed with the crankcase.

7. Crankcase according to claim 6, wherein the chamber forming the oil supply space is closed off with respect to atmosphere by way of a covering.

8. Crankcase according to claim 3, wherein a plurality of said chambers are connected with one another to form a common oil supply space.

9. Crankcase according to claim 8, wherein the chambers forming the oil supply space are closed off with respect to atmosphere by way of a covering.

10. Crankcase according to claim 3, wherein at least one of auxiliary assemblies, heat exchangers, and filters are arranged in the chambers.

11. Crankcase according to claim 10, wherein an auxiliary assembly in the form of an oil pump is arranged in a respective one of the chambers.

12. Crankcase according to claim 10, wherein a heat exchanger is arranged in a respective one of the chambers.

13. Crankcase according to claim 10, wherein heat exchangers and filters are arranged in the chambers.

14. Crankcase according to claim 1, wherein the base surface of the crankcase in an area of the crankshaft space is closed off by means of a bottom lid to form an integrated oil supply space.

15. Crankcase according to claim 1, wherein each end wall has a cross bar in an area of the base surface of the crankcase.

16. Crankcase according to claim 15, wherein the cross bars are undetachably connected with the crankcase when in an assembled condition.

17. Crankcase according to claim 1, wherein a plurality of bearing bridges for bearing a crankshaft are arranged in the crankshaft supporting space, and wherein the bearing bridges are fastened by screws from a direction of the longitudinal side and from a direction of the base surface of the crankcase.

18. Crankcase according to claim 1, wherein a charge air collecting tube is at least partially an integral component of the crankcase.

19. An internal combustion engine assembly comprising a crankcase which has a parallelepiped construction with a rectangular cross-section, a base side of the parallelepiped corresponding approximately to a lateral projection in an area of cylinder heads installed in use on the crankcase, wherein in an in use position the crankcase has at least one chamber which extends from a longitudinal side of the crankcase into the interior of the crankcase, and wherein the at least one chamber is formed of two crankcase end walls, a portion of a base surface and a wall bounding a crankshaft supporting space.

20. An engine assembly according to claim 19, wherein a plurality of said chambers are arranged on each longitudinal side of the crankcase, the chambers being separated from one another by means of one transverse wall respectively, and wherein the transverse walls are constructed in one piece with the crankcase.

21. An engine assembly according to claim 20, wherein auxiliary assemblies, heat exchangers, filters and oil supply spaces are arranged in the chambers.

22. An engine assembly according to claim 21, wherein the auxiliary assemblies, in the form of pumps, and the oil supply spaces are arranged in respective chambers on one side of the crankcase and the heat exchangers and filters are arranged in perspective chambers on the other side of the crankcase.

23. An engine assembly according to claim 20, wherein one of the chambers forms a closed oil supply space for an engine formed with the crankcase.

24. An engine assembly according to claim 23, wherein the chamber forming the oil supply space is closed off with respect to atmosphere by way of a covering.

25. An engine assembly according to claim 20, wherein a plurality of said chambers are connected with one another to form a common oil supply space.

26. An engine assembly according to claim 25, wherein the chambers forming the oil supply space are closed off with respect to atmosphere by way of a covering.

27. An engine assembly according to claim 20, wherein at least one of auxiliary assemblies, heat exchangers, and filters are arranged in the chambers.

28. An engine assembly according to claim 27, wherein an auxiliary assembly in the form of an oil pump is arranged in a respective one of the chambers.

29. An engine assembly according to claim 27, wherein a heat exchanger is arranged in a respective one of the chambers.

30. An engine assembly according to claim 27, wherein heat exchangers and filters are arranged in the chambers.

31. An engine assembly according to claim 19, wherein the base surface of the crankcase in an area of the crankshaft space is closed off by means of a bottom lid to form an integrated oil supply space.

32. An engine assembly according to claim 19, wherein each end wall has a cross bar in an area of the base surface of the crankcase.

33. An engine assembly according to claim 32, wherein the cross bars are undetachably connected with the crankcase when in an assembled condition.

34. An engine assembly according to claim 19, wherein a plurality of bearing bridges for bearing a crankshaft are arranged in the crankshaft supporting space, and wherein the bearing bridges are fastened by means of screws from a direction of the longitudinal side and from a direction of the base surface of the crankcase.

35. An assembly according to claim 19, wherein a charge air collecting tube is at least partially an integral component of the crankcase.

36. A method of making an internal combustion engine comprising:

casting a one piece crankcase with a crankshaft supporting space and a plurality of chambers extending laterally outwardly from the crankshaft supporting space, said crankcase having a parallelepiped construction with a rectangular cross section, a base side of the parallelepiped corresponding in size approximately to a planar projection of cylinder heads mounted on the crankcase when in an assembled engine position, said chambers being formed by crankcase end walls, a base section of the crankcase and a crankshaft supporting space wall, and installing auxiliary engine assemblies in said chambers within said crankcase profile.

37. A method according to claim 36, comprising forming engine oil and engine oil pump accommodating spaces in the chambers.

38. A method according to claim 37, wherein a charge air collecting tube is at least partially an integral component of the crankcase.

39. Crankcase for an internal-combustion engine in a V-arrangement, wherein the crankcase has a parallelepiped construction with a rectangular cross-section, wherein in an in use position the crankcase has a plurality of chambers which extend from a longitudinal side of the crankcase into the interior of the crankcase, the chambers being separated from one another by respective transverse walls wherein at least one chamber is formed of crankcase end walls, a portion of a base surface and a wall bounding a crankshaft supporting space, wherein the transverse walls are constructed in one piece with the crankcase, and wherein at least one of auxiliary assemblies, heat exchangers, and filters are arranged in the chambers.

40. Crankcase according to claim 39, wherein auxiliary assemblies, heat exchangers, filters and oil supply spaces are arranged in the chambers.

41. Crankcase according to claim 40, wherein the auxiliary assemblies, in the form of pumps, and the oil supply spaces are arranged in respective chambers on one side of the crankcase and the heat exchangers and filters are arranged in respective chambers on the other side of the crankcase.

42. Crankcase for an internal-combustion engine in a V-arrangement, wherein the crankcase has a parallelepiped construction with a rectangular cross-section, wherein in an in use position the crankcase has at least one chamber which extends from a longitudinal side of the crankcase into the interior of the crankcase, wherein the at least one chamber is formed of crankcase end walls, a portion of a base surface and a wall bounding a crankshaft supporting space, and wherein each end wall has a cross bar in an area of the base surface of the crankcase.

43. Crankcase according to claim 42, wherein the cross bars are undetachably connected with the crankcase when in an assembled condition.

* * * * *